US008122836B1

(12) United States Patent
Stone

(10) Patent No.: US 8,122,836 B1
(45) Date of Patent: Feb. 28, 2012

(54) TILT TABLE SYSTEM

(76) Inventor: Holden Lee Stone, Sun City Center, FL (US)

( * ) Notice: Subject to any disclaimer, the term of this patent is extended or adjusted under 35 U.S.C. 154(b) by 0 days.

(21) Appl. No.: 12/924,895

(22) Filed: Oct. 7, 2010

(51) Int. Cl.
*A47F 5/12* (2006.01)

(52) U.S. Cl. ..... 108/6

(58) Field of Classification Search ..... 108/6, 7, 108/91–94
See application file for complete search history.

(56) References Cited

U.S. PATENT DOCUMENTS 3,606,450 A * 9/1971 Sedgwick ..... 297/149
4,077,333 A * 3/1978 Ballas ..... 108/6
4,672,898 A * 6/1987 Davidson ..... 108/6

* cited by examiner

*Primary Examiner* — Jose V Chen
*Assistant Examiner* — Matthew Ing

(57) ABSTRACT

A primary work board has upper and lower surfaces. Bearing sleeves depend downwardly from the lower surface. A base has horizontal rods and a vertical rod. A support tube extends laterally from the vertical rod. Vertically extending parallel side walls extend upwardly from the primary work board to form a lower chamber there between. A secondary work board has upper and lower surfaces. Side, front and rear walls extend upwardly from the secondary work board to form a secondary chamber there between. Lower hinges pivotally couple the secondary work board and one side wall of the primary work board.

2 Claims, 4 Drawing Sheets

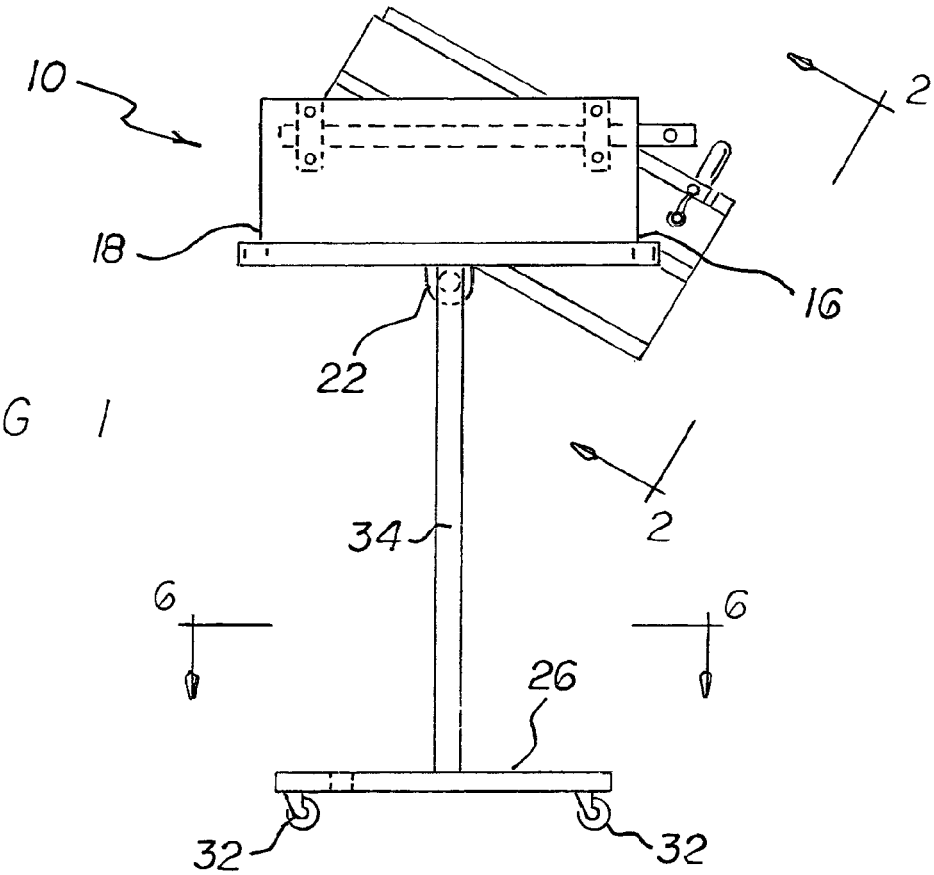
FIG 1
FIG 2
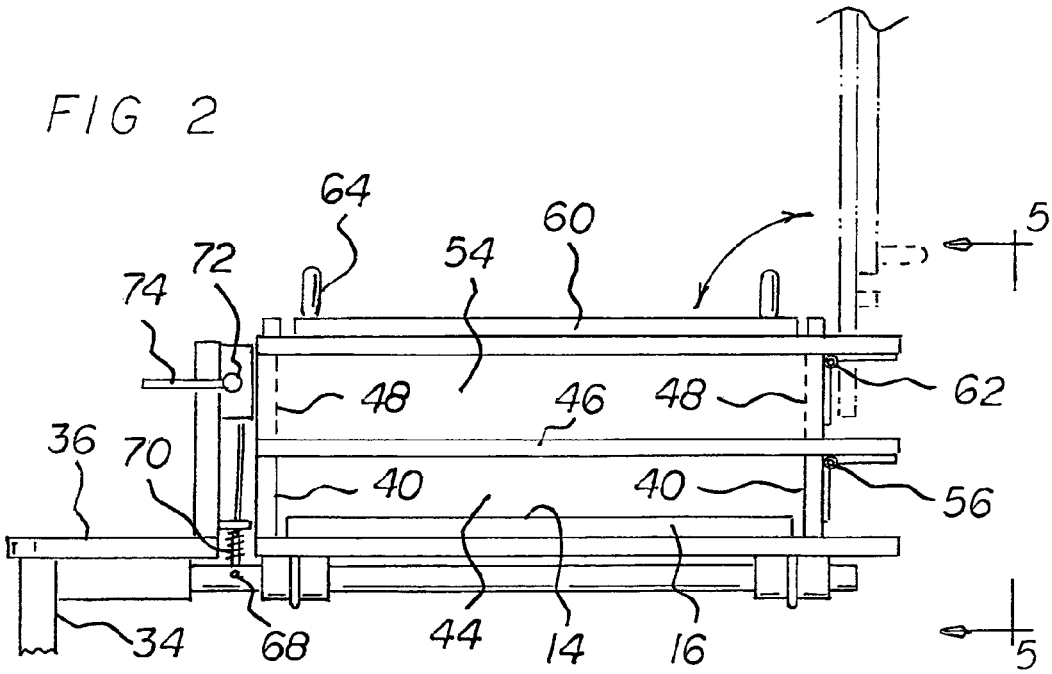

FIG 3
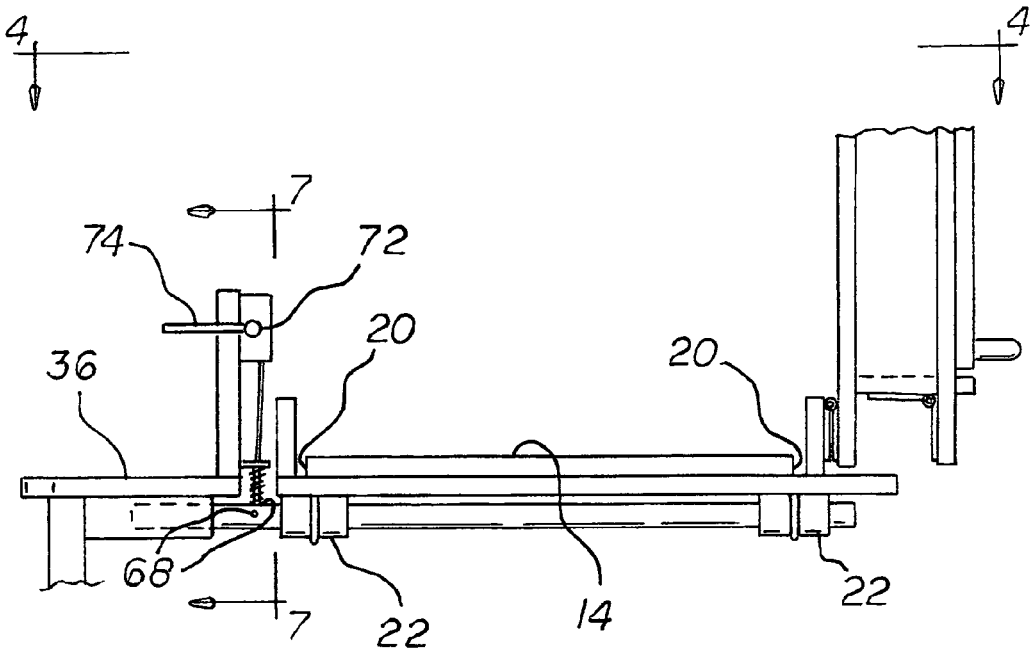
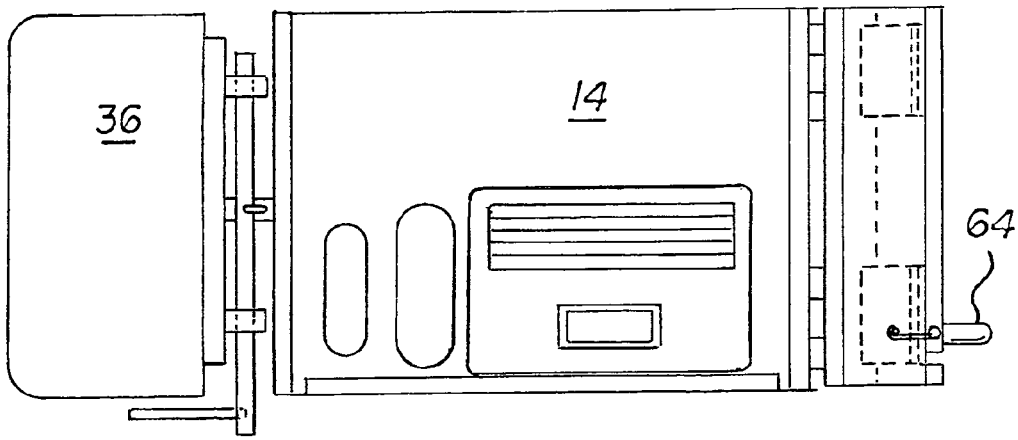
FIG 4

FIG 5
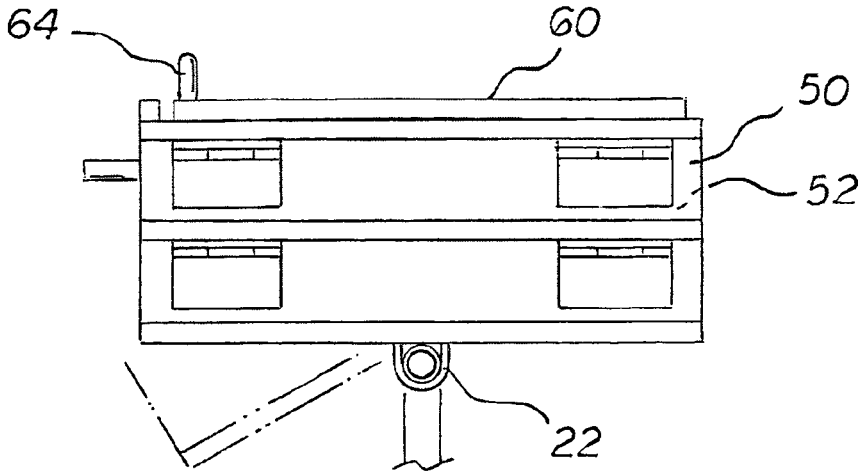
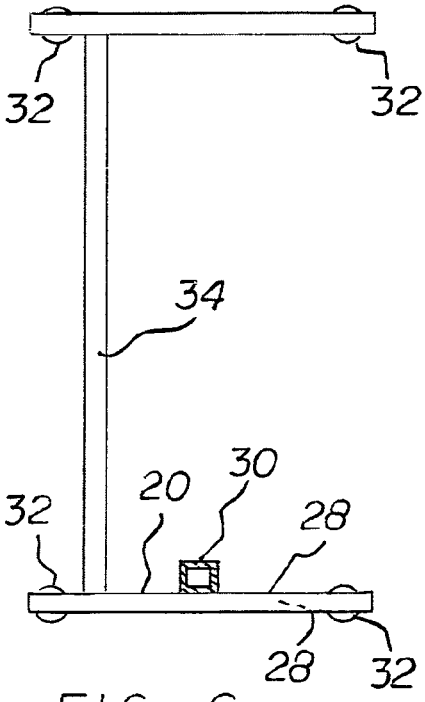
FIG 6
FIG 7
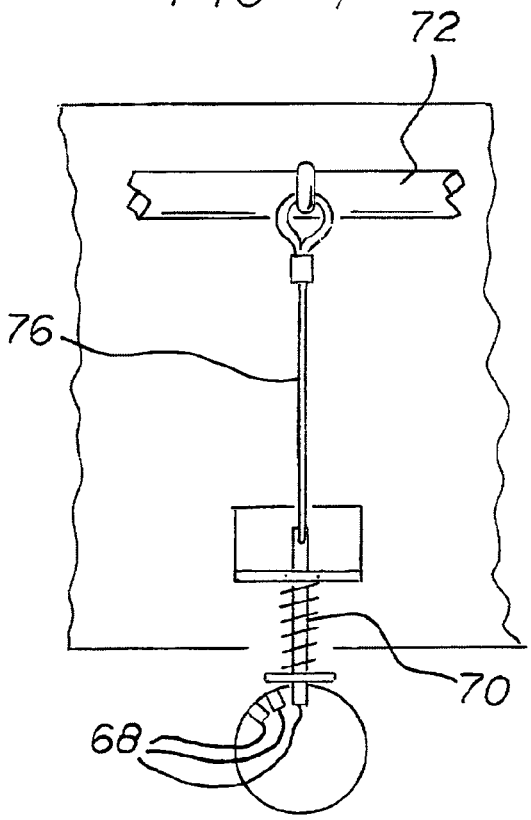

FIG. 8
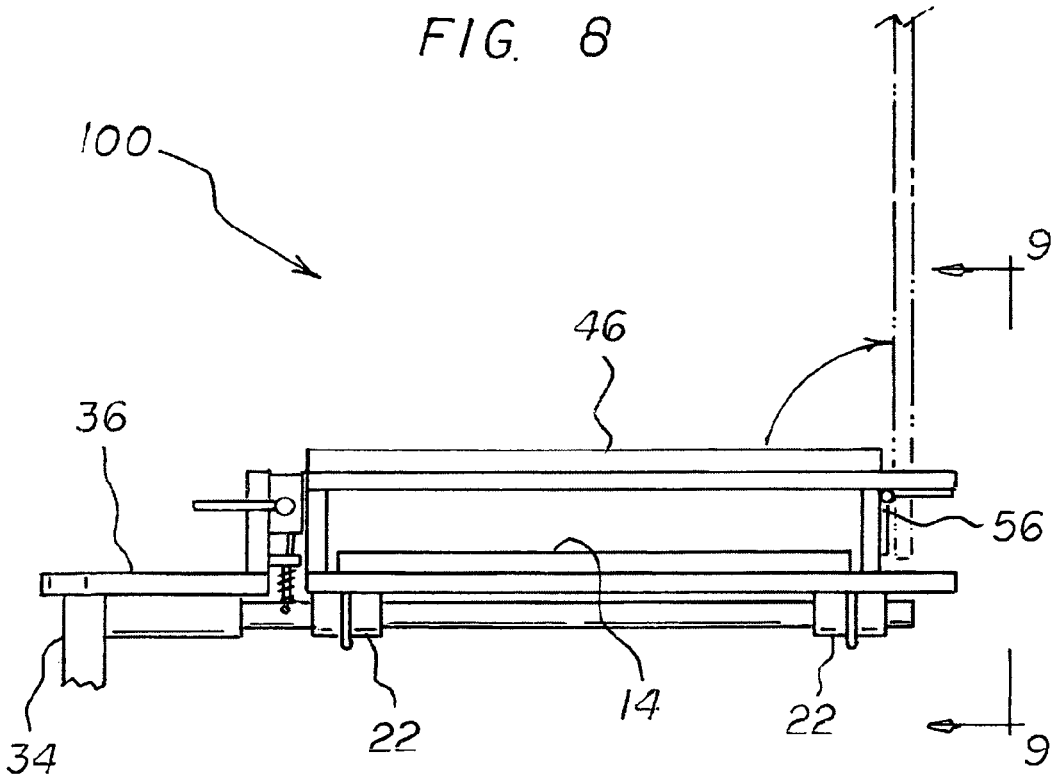
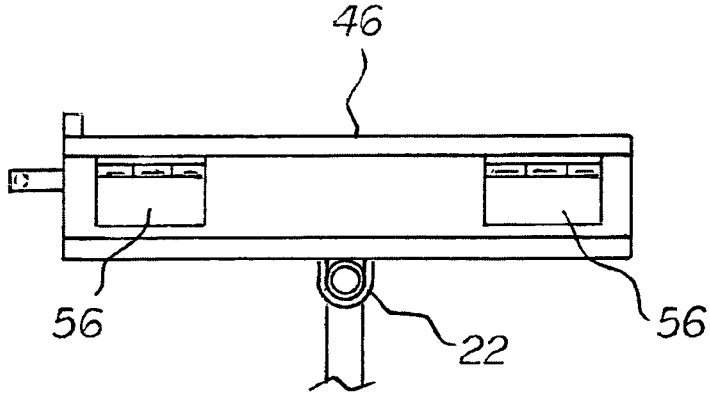
FIG 9

TILT TABLE SYSTEM

BACKGROUND OF THE INVENTION

Field of the Invention

The present invention relates to a tilt table system and more particularly pertains to being adapted to be repositioned with respect to a user whether sitting or reclining, the system adapted to be reconfigured for a variety of functions, the repositioning and reconfiguring being done in a safe, convenient and economical manner.

SUMMARY OF THE INVENTION

In view of the foregoing disadvantages inherent in the known types of table systems of known designs and configurations now present in the prior art, the present invention provides an improved tilt table system. As such, the general purpose of the present invention, which will be described subsequently in greater detail, is to provide a new and improved tilt table system and method which has all the advantages of the prior art and none of the disadvantages.

To attain this, the present invention essentially comprises a tilt table system. First provided is a primary work board. The primary work board has an upper surface and a lower surface. The primary work board has a front edge. The primary work board has a parallel rear edge. The primary work board has parallel side edges. Two laterally spaced bearing sleeves are provided. The sleeves depend downwardly from the lower surface of the primary work board.

A base is provided. The base has horizontal laterally spaced parallel side rods. The base has a transverse forward rod. In this manner an open front is formed. Further in this manner a chair of a user is received. The base has four casters. The casters depend from the side rods in a rectangular configuration. In this manner the system may be repositioned with respect to a user. The base has a vertical rod. The vertical rod has an upper end and a lower end. The lower end is coupled to one of the side rods at a central extent thereof. An auxiliary work board is provided. The auxiliary work board is secured to the upper end of the vertical rod. A support tube is provided. The support tube extends laterally from, and is rotatably supported in, the auxiliary work board. The bearing sleeves are received by the support tube. In this manner the angular orientation of the primary work board may be varied with respect to the horizontal.

Vertically extending parallel side walls are provided. The side walls are secured to and extend upwardly from the primary work board adjacent to the side edges. In this manner a lower chamber is formed there between. The front edge and the rear edge are devoid of vertically extending walls. In this manner a passageway is provided across the upper surface of the primary work board.

Provided next is a secondary work board. The secondary work board has an upper surface and a lower surface. The secondary work board has a front edge, a parallel rear edge and parallel side edges. The secondary work board has two laterally spaced side walls. The secondary work board has a front wall. The secondary work board has a rear wall. The walls extend upwardly from the upper surface of the secondary work board. In this manner a secondary chamber is created there between. Lower hinges are provided. The lower hinges pivotally couple the secondary work board and one side wall of the primary work board. The secondary work board and its side, front and rear walls are rotatable between a lower horizontal orientation and a raised orientation. In the lower horizontal orientation, the secondary work board and its walls are provided overlying the primary work board while closing the lower chamber. In the raised orientation, the secondary work board and its walls are provided extending upwardly perpendicular with respect to the primary work board and opening the lower chamber.

Further provided is a tertiary work board. The tertiary work board has an upper surface and a lower surface. The tertiary work board has a front edge, a parallel rear edge and parallel side edges. Upper hinges are provided. The upper hinges pivotally couple the tertiary work board and one side wall of the secondary work board. The tertiary work board is rotatable between a lower horizontal orientation and a raised orientation. In the lower horizontal orientation, the tertiary work board is provided overlying the primary and secondary work boards while closing the upper chamber. In the raised orientation, the tertiary work board is provided extending upwardly perpendicular from the primary and secondary work board and opening the upper chamber. The upper surface of the tertiary work board has areas for a computer and other devices. The upper surface of the tertiary work board has upstanding handles. The handles are adapted to be held by a user. In this manner the repositioning the system is facilitated.

Provided last is a reorientation assembly. In this manner the angular orientation of the support tube, the work boards and the chambers may be varied. The reorientation assembly includes radial apertures. The radial apertures are circumferentially spaced around the support tube between the primary and auxiliary work boards. The reorientation assembly includes a vertical locking pin. The vertical locking pin is reciprocable between a locking lower orientation within a preselected aperture and a reorienting raised orientation above the apertures. The reorientation assembly includes a drive cylinder. The reorientation assembly also includes a handle. The handle is rotatable above the pin. The reorientation assembly further includes a cord. The cord couples the pin and the cylinder. In this manner raising of the pin is facilitated. The reorientation assembly includes a spring. The spring urges the pin downwardly to insure retention of the pin in an aperture and the secure positioning of the work boards and chambers during use of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tilt table system which has all of the advantages of the prior art table systems of known designs and configurations and none of the disadvantages.

It is another object of the present invention to provide a new and improved tilt table system which may be easily and efficiently manufactured and marketed.

It is further object of the present invention to provide a new and improved tilt table system which is of durable and reliable constructions.

An even further object of the present invention is to provide a new and improved tilt table system which is susceptible of a low cost of manufacture with regard to both materials and labor, and which accordingly is then susceptible of low prices of sale to the consuming public, thereby making such tilt table system economically available to the buying public.

Even still another object of the present invention is to provide a tilt table system for being adapted to be repositioned with respect to a user whether sitting or reclining, the system adapted to be reconfigured for a variety of functions, the repositioning and reconfiguring being done in a safe, convenient and economical manner.

Lastly, it is an object of the present invention to provide a new and improved tilt table system. A primary work board has upper and lower surfaces. Bearing sleeves depend downwardly from the lower surface. A base has horizontal rods and a vertical rod. A support tube extends laterally from the vertical rod. Vertically extending parallel side walls extend upwardly from the primary work board to form a lower chamber there between. A secondary work board has upper and lower surfaces. Side, front and rear walls extend upwardly from the secondary work board to form a secondary chamber there between. Lower hinges pivotally couple the secondary work board and one side wall of the primary work board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a tilt table system constructed in accordance with the principles of the present invention.

FIG. 2 is a front elevational view taken along line 2-2 of FIG. 1.

FIG. 3 is a front elevational view similar to FIG. 2 but with upper components in the open orientation.

FIG. 4 is a plan view of the open system taken along line 4-4 of FIG. 3.

FIG. 5 is a side elevational view taken along line 5-5 of FIG. 2.

FIG. 6 is a cross sectional view taken along line 6-6 of FIG. 1.

FIG. 7 is a cross sectional view taken along line 7-7 of FIG. 3.

FIGS. 8 and 9 are elevational views similar to FIGS. 2 and 5 but illustrating an alternate embodiment of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved tilt table system embodying the principles and concepts of the present invention and generally designated by the reference numeral 10 will be described.

The present invention, the tilt table system 10 is comprised of a plurality of components. Such components in their broadest context include a primary work board, a base, vertically extending parallel side walls, a secondary work surface, side, front and rear walls and hinges. Such components are individually configured and correlated with respect to each other so as to attain the desired objective.

First provided is a primary work board 14. The primary work board has an upper surface and a lower surface. The primary work board has a front edge 16. The primary work board has a parallel rear edge 18. The primary work board has parallel side edges 20. Two laterally spaced bearing sleeves 22 are provided. The sleeves depend downwardly from the lower surface of the primary work board.

A base 26 is provided. The base has horizontal laterally spaced parallel side rods 28. The base has a transverse forward rod 30. In this manner an open front is formed. Further in this manner a chair of a user is received. The base has four casters 32. The casters depend from the side rods in a rectangular configuration. In this manner the system may be repositioned with respect to a user. The base has a vertical rod 34. The vertical rod has an upper end and a lower end. The lower end is coupled to one of the side rods at a central extent thereof. An auxiliary work board 36 is provided. The auxiliary work board is secured to the upper end of the vertical rod. A support tube is provided. The support tube extends laterally from, and is rotatably supported in, the auxiliary work board. The bearing sleeves are received by the support tube. In this manner the angular orientation of the primary work board may be varied with respect to the horizontal.

Vertically extending parallel side walls 40 are provided. The side walls are secured to and extend upwardly from the primary work board adjacent to the side edges. In this manner a lower chamber 42 is formed there between. The front edge and the rear edge are devoid of vertically extending walls. In this manner a passageway is provided across the upper surface of the primary work board.

Provided next is a secondary work board 46. The secondary work board has an upper surface and a lower surface. The secondary work board has a front edge, a parallel rear edge and parallel side edges. The secondary work board has two laterally spaced side walls 48. The secondary work board has a front wall 50. The secondary work board has a rear wall 52. The walls extend upwardly from the upper surface of the secondary work board. In this manner a secondary chamber 54 is created there between. Lower hinges 56 are provided. The lower hinges pivotally couple the secondary work board and one side wall of the primary work board. The secondary work board and its side, front and rear walls are rotatable between a lower horizontal orientation and a raised orientation. In the lower horizontal orientation, the secondary work board and its walls are provided overlying the primary work board while closing the lower chamber. In the raised orientation, the secondary work board and its walls are provided extending upwardly perpendicular with respect to the primary work board and opening the lower chamber.

Further provided is a tertiary work board 60. The tertiary work board has an upper surface and a lower surface. The tertiary work board has a front edge, a parallel rear edge and parallel side edges. Upper hinges 62 are provided. The upper hinges pivotally couple the tertiary work board and one side wall of the secondary work board. The tertiary work board is rotatable between a lower horizontal orientation and a raised orientation. In the lower horizontal orientation, the tertiary work board is provided overlying the primary and secondary work boards while closing the upper chamber. In the raised orientation, the tertiary work board is provided extending upwardly perpendicular from the primary and secondary work board and opening the upper chamber. The upper surface of the tertiary work board has areas for a computer and other devices. The upper surface of the tertiary work board has upstanding handles 64. The handles are adapted to be held by a user. In this manner the repositioning the system is facilitated.

Provided last is a reorientation assembly. In this manner the angular orientation of the support tube, the work boards and the chambers may be varied. The reorientation assembly includes radial apertures 68. The radial apertures are circumferentially spaced around the support tube between the primary and auxiliary work boards. The reorientation assembly includes a vertical locking pin 70. The vertical locking pin is reciprocable between a locking lower orientation within a preselected aperture and a reorienting raised orientation above the apertures. The reorientation assembly includes a drive cylinder 72. The reorientation assembly also includes a handle 74. The handle is rotatable above the pin. The reorientation assembly further includes a cord 76. The cord couples the pin and the cylinder. In this manner raising of the pin is facilitated. The reorientation assembly includes a spring. The spring urges the pin downwardly to insure retention of the pin in an aperture and the secure positioning of the work boards and chambers during use of the system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tilt table system comprising:

a primary work board having upper and lower surfaces, bearing sleeves depending downwardly from the lower surface;

a base having horizontal rods and a vertical rod, a support tube extending laterally from the vertical rod;

vertically extending parallel side walls extending upwardly from the primary work board to form a lower chamber there between;

a secondary work board having upper and lower surfaces;

side and front and rear walls extending upwardly from the secondary work board to form a secondary chamber there between;

lower hinges pivotally coupling the secondary work board and one side wall of the primary work board;

a drive cylinder with a handle rotatable above the pin with a cord coupling the pin and the cylinder to facilitate the raising of the pin; and a spring urging the pin downwardly to insure retention of the pin in an aperture and the secure positioning of the work boards and chambers during use of the system.

2. A tilt table system (10) adapted to be repositioned with respect to a user whether sitting or reclining, the system adapted to be reconfigured for a variety of functions, the repositioning and reconfiguring being done in a safe, convenient and economical manner, the system comprising, in combination:

a primary work board (14) having an upper surface and a lower surface, the primary work board having a front edge (16) and a parallel rear edge (18) and parallel side edges (20), two laterally spaced bearing sleeves (22) depending downwardly from the lower surface of the primary work board;

a base (26) having horizontal laterally spaced parallel side rods (28) and a transverse forward rod (30) forming an open front for receiving a chair of a user, the base having four casters (32) depending from the side rods in a rectangular configuration for repositioning of the system with respect to a user, the base including a vertical rod (34) having an upper end and a lower end, the lower end being coupled to one of the side rods at a central extent thereof, an auxiliary work board (36) secured to the upper end of the vertical rod, a support tube extending laterally from, and rotatably supported in, the auxiliary work board, the bearing sleeves being received by the support tube for varying the angular orientation of the primary work board with respect to the horizontal;

vertically extending parallel side walls (40) secured to and extending upwardly from the primary work board adjacent to the side edges to form a lower chamber (42) there between, the front edge and the rear edge being devoid of vertically extending walls to thereby create a passageway across the upper surface of the primary work board;

a secondary work board (46) having an upper surface and a lower surface, the secondary work board having a front edge and a parallel rear edge and parallel side edges, two laterally spaced side walls (48) and a front wall (50) and a rear wall (52) extending upwardly from the upper surface of the secondary work board to thereby create a secondary chamber (54) there between, lower hinges (56) pivotally coupling the secondary work board and one side wall of the primary work board, the secondary work board and its side and front and rear walls being rotatable between a lower horizontal orientation overlying the primary work board while closing the lower chamber and a raised orientation extending upwardly perpendicular with respect to the primary work board and opening the lower chamber;

a tertiary work board (60) having an upper surface and a lower surface, the tertiary work board having a front edge and a parallel rear edge and parallel side edges, upper hinges (62) pivotally coupling the tertiary work board and one side wall of the secondary work board, the tertiary work board being rotatable between a lower horizontal orientation overlying the primary and secondary work boards while closing the upper chamber and a raised orientation extending upwardly perpendicular from the primary and secondary work board and opening the upper chamber, the upper surface of the tertiary work board having areas for a computer and other devices, the upper surface of the tertiary work board having upstanding handles (64) adapted to be held by a user to facilitate repositioning the system; and a reorientation assembly for varying the angular orientation of the support tube and the work boards and the chambers, radial apertures (68) circumferentially spaced around the support tube between the primary and auxiliary work boards, a vertical locking pin (70) reciprocable between a locking lower orientation within a preselected aperture and a reorienting raised orientation above the apertures, a drive cylinder (72) with a handle (74) rotatable above the pin with a cord (76) coupling the pin and the cylinder to facilitate the raising of the pin, and a spring urging the pin downwardly to insure retention of the pin in an aperture and the secure positioning of the work boards and chambers during use of the system.

* * * * *